US006662991B1

(12) United States Patent
Huang

(10) Patent No.: US 6,662,991 B1
(45) Date of Patent: Dec. 16, 2003

(54) STAPLE EXPELLING DEVICE FOR STAPLERS

(76) Inventor: Chien-Kai Huang, No. 136, Tsu Chiang Road, Chang Hua City (TW)

( * ) Notice: Subject to any disclaimer, the term of this patent is extended or adjusted under 35 U.S.C. 154(b) by 0 days.

(21) Appl. No.: 10/442,158

(22) Filed: May 21, 2003

(51) Int. Cl.[7] ..... B25C 1/04
(52) U.S. Cl. ..... 227/151; 227/5; 227/134
(58) Field of Search ..... 227/5, 6, 7, 151, 227/154, 120, 134, 140

(56) References Cited

U.S. PATENT DOCUMENTS 2,073,958 A * 3/1937 Crosby ..... 227/151
2,786,203 A * 3/1957 Treciokas ..... 227/140
2,897,500 A * 4/1959 Lang ..... 227/151
3,523,634 A * 8/1970 Power et al. ..... 227/120
5,267,682 A * 12/1993 Okouchi ..... 227/151
5,692,667 A * 12/1997 Chi ..... 227/134

* cited by examiner

*Primary Examiner*—Scott A. Smith
(74) *Attorney, Agent, or Firm*—Bacon & Thomas, PLLC

(57) ABSTRACT

A stapler includes a base with a document guide connected to a top thereof and an arm and a magazine casing are respectively pivotably connected to a connection frame on the base. The document guide includes a first protrusion and a second protrusion. At least one groove is defined in an outer periphery of the second protrusion. A rotatable member is rotatably mounted to the second protrusion and includes at least one rib which is disengagably engaged with the at least one groove. A support portion is connected to the rotatable member so that when the rotatable member is rotated, the support portion is switched below the magazine casing which is stopped by the support portion such that the jammed staple can be ejected by pushing the arm downward.

4 Claims, 6 Drawing Sheets

STAPLE EXPELLING DEVICE FOR STAPLERS

FIELD OF THE INVENTION

The present invention relates to a stapler which includes a rotatable member connected on the document guide and can be pivoted an angle to be located on a center axis such that the magazine casing may be supported on the rotatable member so that the jammed staple can be expelled by pushing the arm.

BACKGROUND OF THE INVENTION

A conventional stapler 10 is disclosed in FIGS. 1 and 2, and generally a base 11 with an arm 14 pivotably connected to a connection frame 100 on the base 11, and a magazine casing 13 is pivotably connected to the connection frame 100 and can be pivoted downward with the downward movement of the arm 14. A push plate 15 is connected to an underside of the arm 14 so as to push the staples 20 received in the space 16 in magazine casing 13. A document guide 12 is movably connected to the base 11 and includes a guide surface 121 such that a pile of document may be guided onto the guide surface 121 and the staples 20 pushed by the push plate 15 penetrate through the pile of the document. As shown in FIG. 2, the staple 20 could be jammed in the magazine casing 13 and cannot be pushed out from the magazine casing 13 by the push plate 15. The user has to insert an object such as a pencil 30 between the base 11 and the magazine casing 13 to form a gap between the magazine casing 13 and the base 11 so that when pushing the push plate 15, the jammed staple 20 can be forced to drop from the magazine casing 13. Nevertheless, the pencil 30 is damaged by the downward force of the magazine casing 13 and this is not convenient at all.

The present invention intends to provide a jammed staples expelling device that is rotatably connected to the document guide and can be easily rotated to support the magazine casing to allow the jammed staple to be expelled by pushing the arm.

SUMMARY OF THE INVENTION

In accordance with one aspect of the present invention, there is provided a stapler which comprises a base with a document guide movably connected to a top thereof and an arm is pivotably connected to a connection frame on the base. A magazine casing located beneath the arm is pivotably connected to the connection frame and a push plate is connected to an underside of the arm and inserted in the magazine casing. The document guide includes a first protrusion and a second protrusion. A guide surface is defined in a side of each of the first protrusion and the second protrusion. At least one groove is defined in an outer periphery of the second protrusion. A rotatable member is rotatably mounted to the second protrusion and includes at least one rib which is disengagably engaged with the at least one groove. A support portion is connected to the rotatable member and switched below the magazine casing by rotating the rotatable member.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
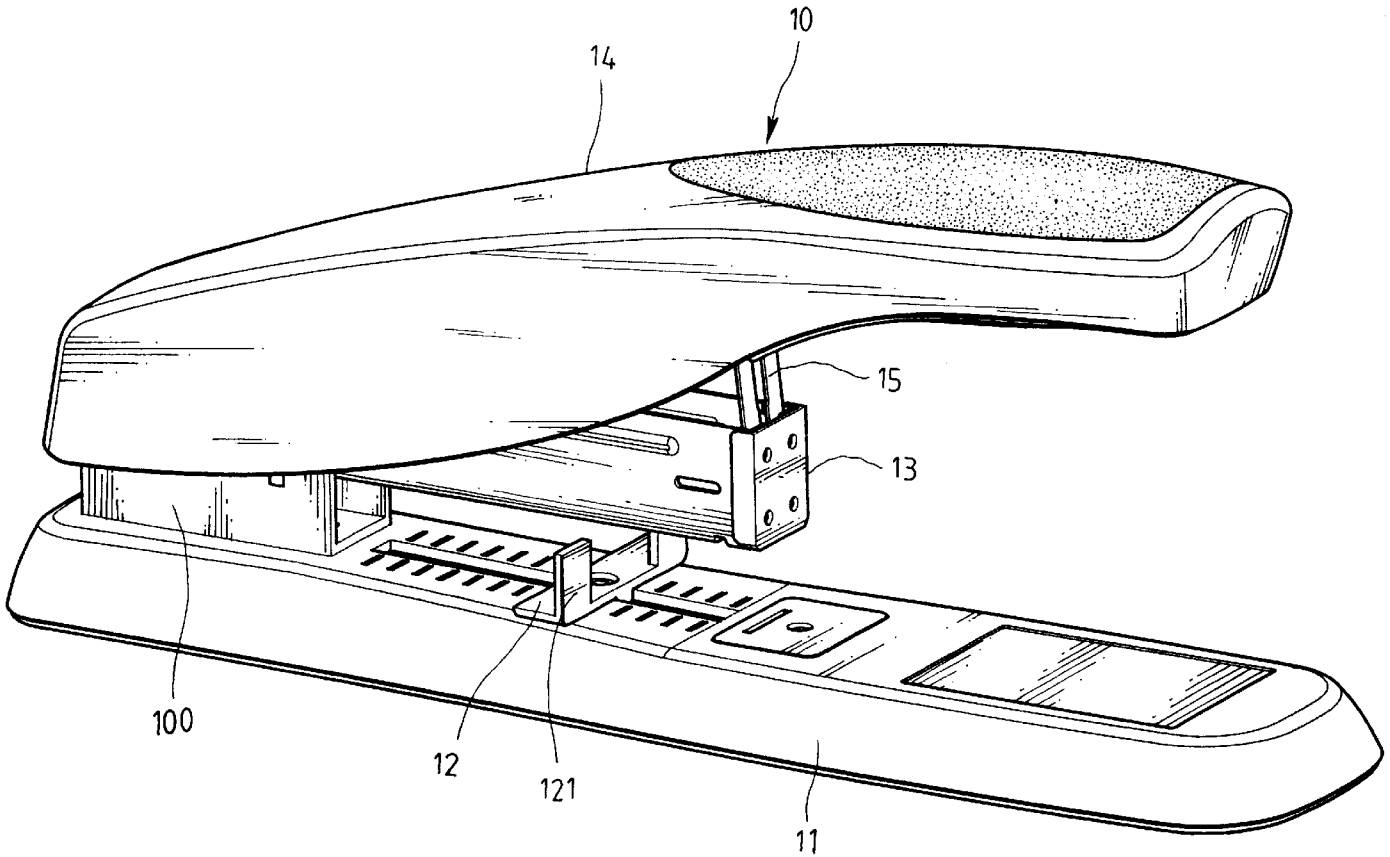
FIG. 1 PRIOR ART
FIG. 1 is a side view of a conventional stapler.
Figure 2:
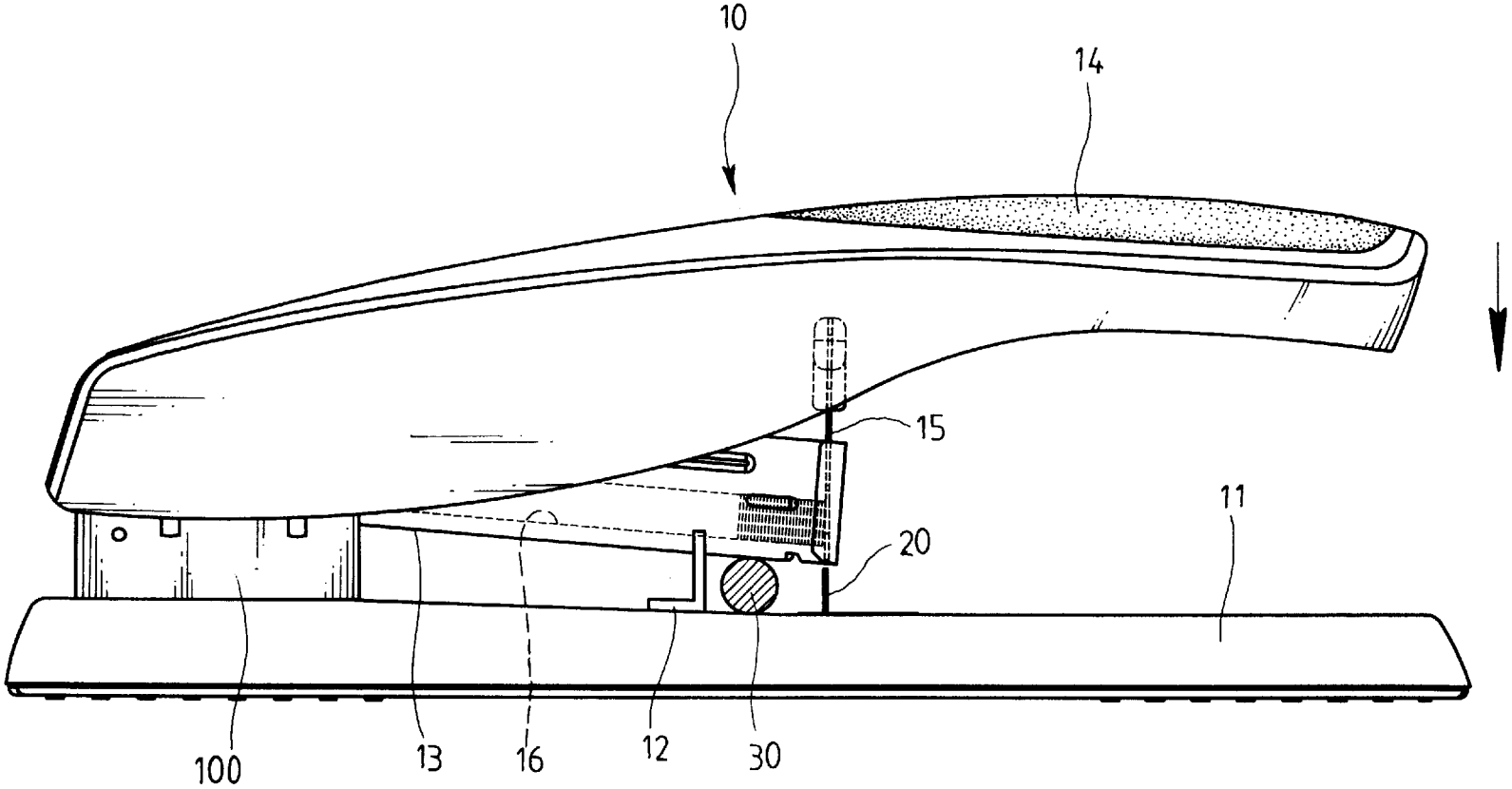
FIG.2 PRIOR ART
FIG. 2 shows that a pencil is inserted between the magazine casing and the base of the conventional stapler o allow the jammed staple to be ejected.
Figure 3:
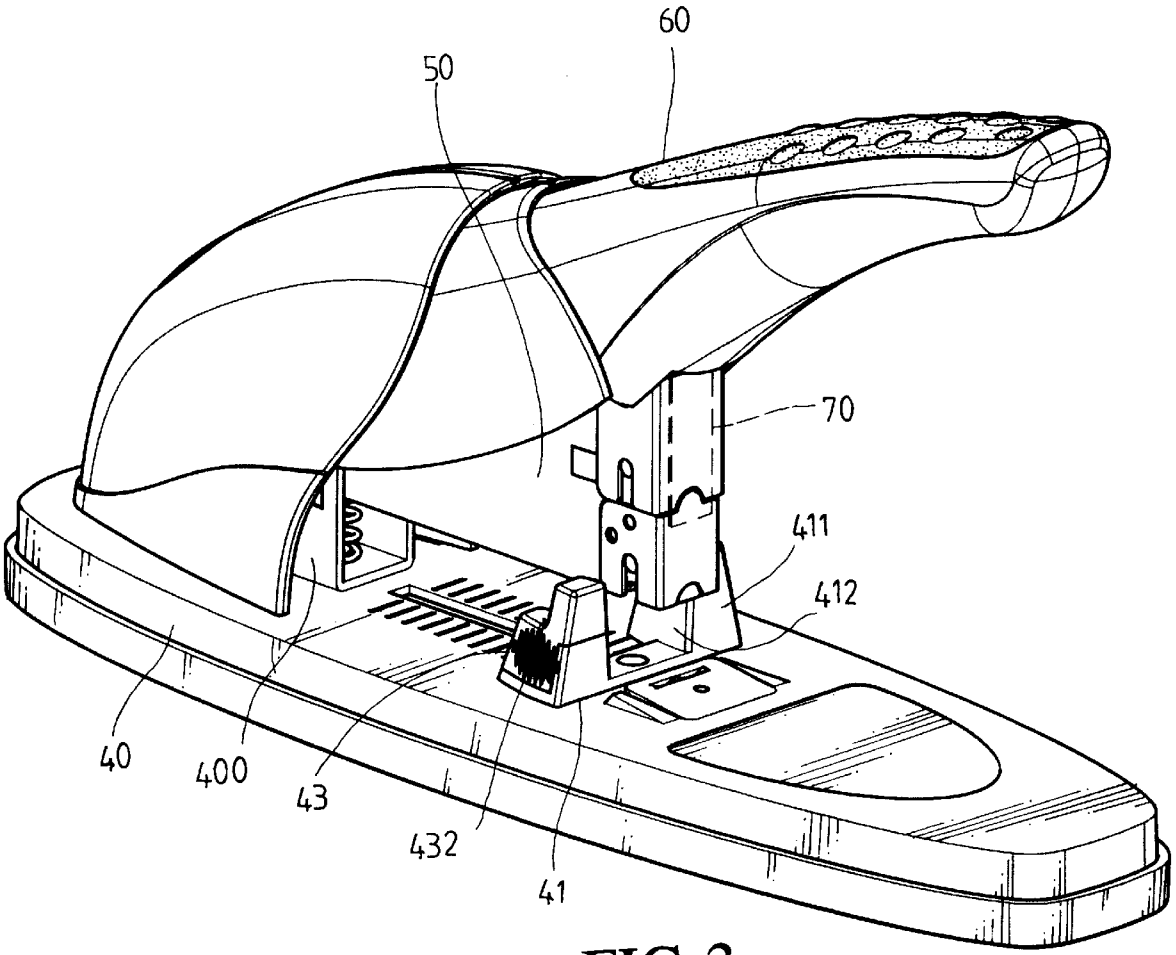
FIG. 3 is a perspective view to show the stapler of the present invention.
Figure 4:
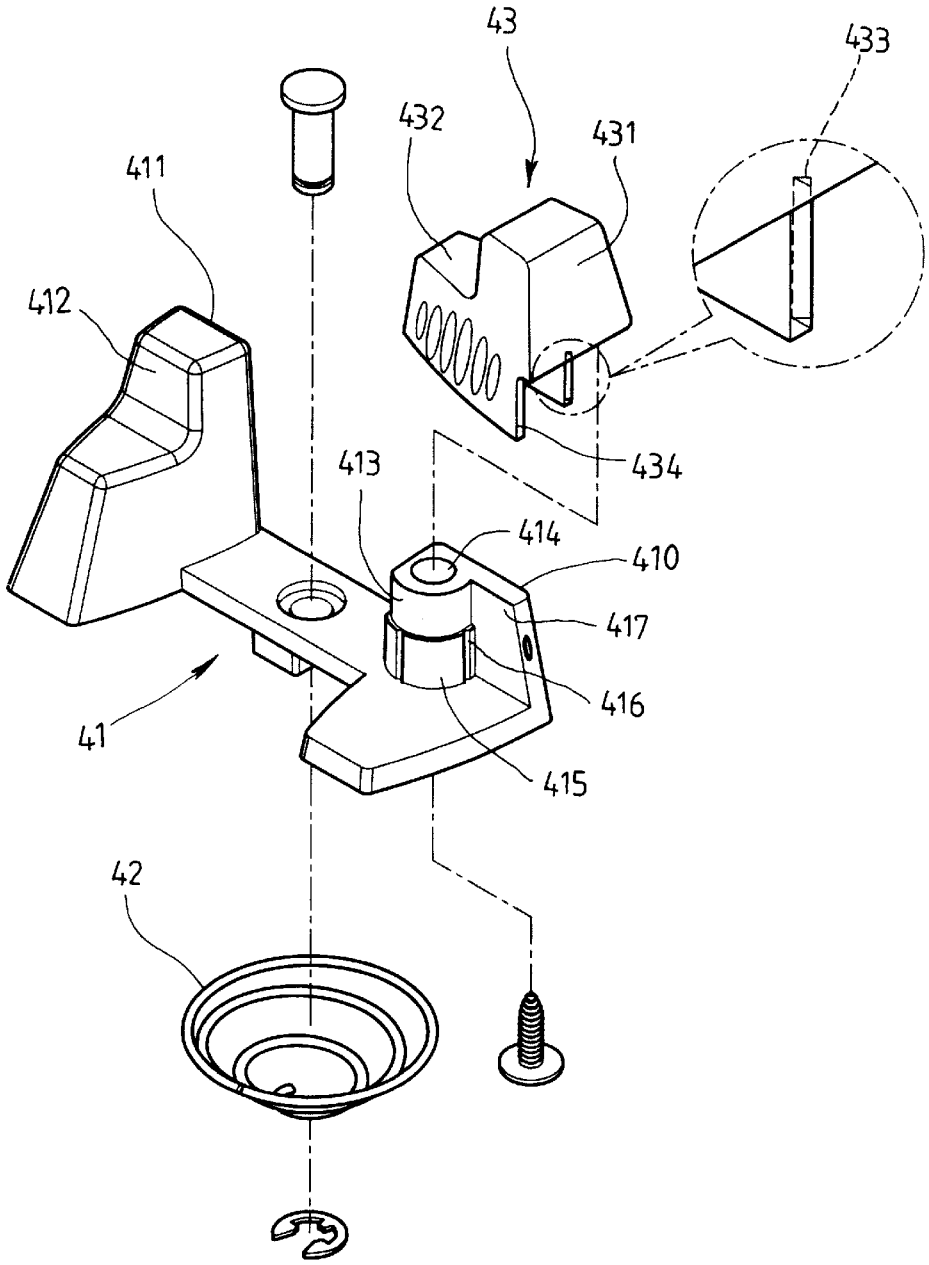
FIG. 4 is an exploded view to show the document guide and the staple expelling device of the present invention.

Referring to FIGS. 3 and 4, the stapler of the present invention comprises a base 40 with a document guide 41 movably connected to a top of the base 40. An arm 60 and a magazine casing 50 are pivotably connected to a connection frame 400 on the base 40 respectively, wherein the magazine casing 50 is located beneath the arm 60. Staples are received in the magazine casing 50 and push plate 70 is connected to an underside of the arm 60 and inserted in the magazine casing 50. The leading staple in the magazine casing 50 can be ejected by the push plate 70 when pushing the arm 60.

A spring 42 is connected to the base 40 and supports the document guide 41. The document guide 41 includes a first protrusion 412 and a second protrusion 413. The magazine casing 50 can be lowered between the first protrusion 412 and the second protrusion 413 to staple the document guided on a guide surface 411/410 defined in a side of each of the first protrusion 412 and the second protrusion 413. The second protrusion 413 is a column connected to a wall 417 which includes the guide surface 410 located in opposite to the second protrusion 413. The guide surface 410 is in flush with the guide surface 411 of the first protrusion 412. At least one groove 416 is defined in an outer periphery of an annular protrusion 415 on the second protrusion 413.

A rotatable member 43 is rotatably mounted to the second protrusion 413 by extending a bolt through a passage 414 defined through the second protrusion 413 and is connected to the rotatable member 43. The rotatable member 43 includes two walls 434 between which the second protrusion 413 is located. A rib 433 extends from one of the two walls 434 so that when the rotatable member 43 is position in a normal position as shown in FIG. 3, The rib 433 is disengagably engaged with the at least one groove 416.

Figure 5A:
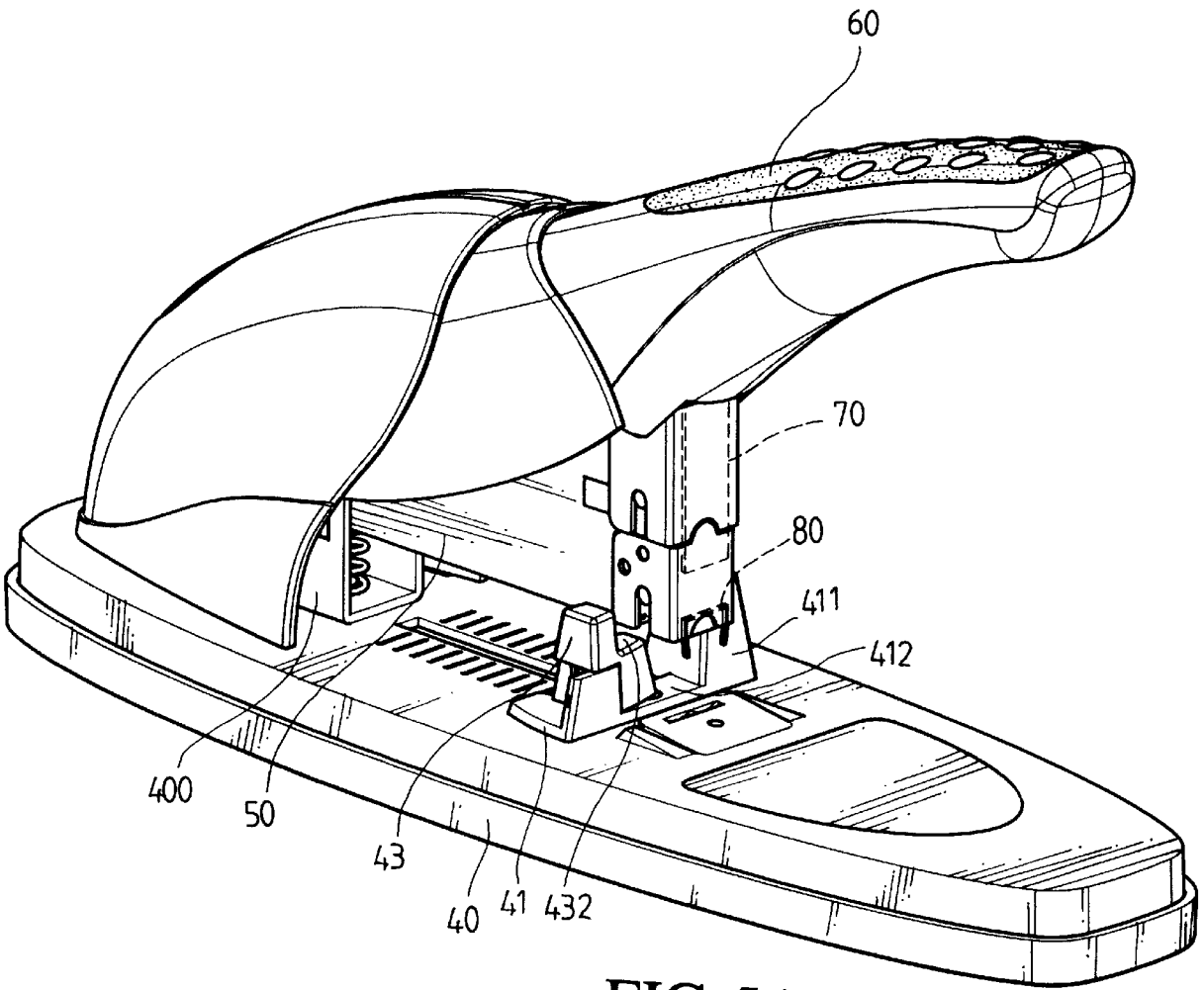
FIG. 5A shows the rotatable member is rotated beneath the magazine casing.
Figure 5B:
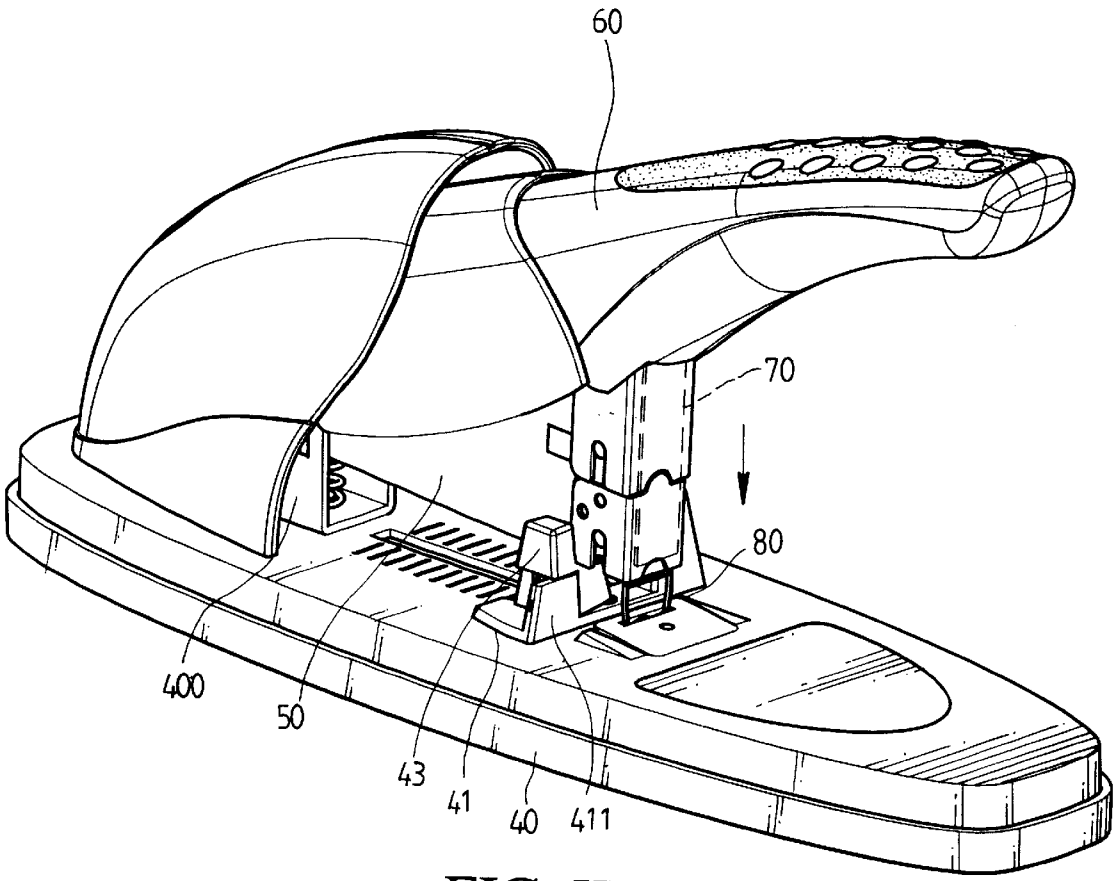
FIG. 5B shows that the jammed staple is ejected by the push plate.

Further referring to FIGS. 5A and 5B, a support portion 432 is connected to the rotatable member 43 and is switched beneath the magazine casing 50 by rotating the rotatable member 43 when a jammed staple 80 is to be ejected out from the magazine casing 50. The arm 60 and the magazine casing 50 are then pushed toward the base 40, the magazine casing 50 is stopped by the support portion 432 while the push plate 70 is moving downward so that the jammed staple 80 is ejected from the magazine casing 50. The rotatable member 43 is then rotated back to its normal position as shown in FIG. 3.

While we have shown and described the embodiment in accordance with the present invention, it should be clear to those skilled in the art that further embodiments may be made without departing from the scope of the present invention.

What is claimed is:

1. A stapler comprising:

a base with a document guide movably connected to a top of the base, an arm pivotably connected to a connection frame on the base, a magazine casing pivotably connected to the connection frame and located beneath the arm, a push plate connected to an underside of the arm and inserted in the magazine casing, the document guide including a first protrusion and a second protrusion, a guide surface defined in a side of each of the first protrusion and the second protrusion, a groove defined in an outer periphery of the second protrusion, a rotatable member rotatably mounted to the second protrusion and including a rib which is disengagably engaged with the groove, a support portion connected to the rotatable member and being switched beneath the magazine casing by rotating the rotatable member.

2. The stapler as claimed in claim 1, wherein a spring is connected to the base and supports the document guide.

3. The stapler as claimed in claim 1, wherein a passage is defined through the second protrusion and a bolt extends through the passage and is connected to the rotatable member.

4. The stapler as claimed in claim 1, wherein the second protrusion is a column connected to a wall which includes a surface in flush with the guide surface of the first protrusion, the rotatable member including two walls between which the second protrusion is located, the rib extending from one of the two walls.

* * * * *